US007717549B2

(12) United States Patent
Rademakers et al.

(10) Patent No.: US 7,717,549 B2
(45) Date of Patent: May 18, 2010

(54) MOUNTING STRUCTURE FOR A PRINTHEAD

(75) Inventors: Albert W. T. Rademakers, Grubbenvorst (NL); Floris J. Marcelis, Venlo (NL)

(73) Assignee: Océ-Technologies B.V., Venlo (NL)

( * ) Notice: Subject to any disclaimer, the term of this patent is extended or adjusted under 35 U.S.C. 154(b) by 739 days.

(21) Appl. No.: 11/583,921

(22) Filed: Oct. 20, 2006

(65) Prior Publication Data

US 2007/0091152 A1 Apr. 26, 2007

(30) Foreign Application Priority Data

Oct. 21, 2005 (EP) ..... 05109848

(51) Int. Cl.
*B41J 2/015* (2006.01)
*B41J 2/17* (2006.01)
*B41J 2/175* (2006.01)

(52) U.S. Cl. ..... 347/85; 347/84; 347/20

(58) Field of Classification Search ..... 347/20, 347/84

See application file for complete search history.

(56) References Cited

U.S. PATENT DOCUMENTS 5,646,665 A 7/1997 Swanson et al.
6,050,672 A 4/2000 Matsuhashi
6,099,112 A 8/2000 Olazabal
6,481,829 B1 11/2002 Bailey et al.
6,648,456 B1 11/2003 Asano et al.
7,431,439 B2 * 10/2008 Fujioka ..... 347/86
2002/0063759 A1 * 5/2002 Hirano et al. ..... 347/85

FOREIGN PATENT DOCUMENTS

EP 1 000 751 A2 5/2000
EP 1 389 530 A1 2/2004

* cited by examiner

*Primary Examiner*—Julian D Huffman
*Assistant Examiner*—Jason S Uhlenhake
(74) *Attorney, Agent, or Firm*—Birch, Stewart, Kolasch & Birch LLP

(57) ABSTRACT

A mounting structure for a printhead having a contact surface and a coupling member for connection to an ink supply line, the mounting structure including a casing which defines a bay for accommodating the printhead therein, and a biasing mechanism for biasing the printhead into engagement with the internal walls of the bay, the biasing mechanism containing a latch member mounted on the casing and movable relative thereto between an open position which permits the printhead to be inserted into the bay, and a latched position where it secures the printhead in the bay, and a contact member adapted to exert a force against the contact surface of the printhead in the latched position. A mating coupling member of an ink supply line is mounted on the latch member so as to be brought into engagement with the coupling member of the printhead when the latch member is moved into the latched position.

15 Claims, 4 Drawing Sheets

MOUNTING STRUCTURE FOR A PRINTHEAD

This application claims the priority benefits of European Patent Application No. 05109848.1 filed on Oct. 21, 2005 which is hereby incorporated by reference.

The present invention relates to a mounting structure for a printhead having a contact surface and a coupling member for connection to an ink supply line, the mounting structure comprising a casing which defines a bay for accommodating the printhead therein, and a biasing mechanism for biasing the printhead into engagement with the internal walls of the bay, the biasing mechanism comprising a latch member mounted on the casing and movable relative thereto between an open position where it permits insertion of the printhead into the bay, and a latched position where it secures the printhead in the bay, and a contact member adapted to exert a force against the contact surface of the printhead in the latched position. The present invention also relates to a combination of a printhead with such a mounting structure and to a carriage for an ink jet printer having such a mounting structure.

U.S. Pat. No. 6,481,829 discloses a mounting structure of the type indicated above, which comprises a mating, coupling member which is brought into engagement with the coupling member of the printhead. The mating coupling member is mounted on a first lever, and the latch member is formed by a second lever which is adapted to lock the first lever in a position in which the coupling members are engaged.

EP-A-1,389,530 discloses a mounting structure for an ink jet printhead, wherein coupling members that are mounted on the printhead and on the casing, respectively, for establishing an ink supply line, are automatically brought into engagement with one another when the printhead is inserted in the bay. In this mounting structure, the printhead is brought into its final position by a tilting movement within the bay, and this tilting movement brings the coupling members into engagement with one another.

Another mounting structure for an ink jet printhead with an integrated ink cartridge is disclosed in U.S. Pat. No. 5,646,665. The printhead has a nozzle face formed on a projecting portion that projects through an opening formed in the walls of the bay so as to face the print medium. The printhead further has a contact surface engaged by an elastically biased contact member for establishing electrical contacts between a control circuit and actuators that are associated with the nozzles of the printhead. In this mounting structure, the biasing mechanism for the printhead comprises a low-friction cam on the free end of a spring that projects from a wall of the bay. When the printhead is inserted, the cam snaps-in at the ramp surface to secure the printhead in its final position within the bay.

SUMMARY OF THE INVENTION

It is an object of the present invention to provide a mounting structure which is easy to handle and ensures a reliable engagement and disengagement of the coupling member when the printhead is respectively inserted into and removed from the bay.

According to the present invention, the mating coupling member of the ink supply line is mounted on the latch member so as to be brought into engagement with the coupling member of the printhead when the latch member is moved into the latched position.

Thus, the movement of the latch is also used for bringing the coupling members of the ink supply line into engagement with one another. As a result, a single operation is sufficient for locking the printhead in position and connecting the coupling member thereof to the in supply line. Conversely, when the printhead is to be removed, the unlocking movement of the latch member will automatically disengage the coupling members before the printhead can be withdrawn from the bay. This has the particular advantage that inadvertent damage of the coupling members can be reliably prevented when a user removes the printhead from the bay.

Preferably, to position and secure the printhead within the bay with improved accuracy and reliability, the biasing mechanism comprises a roller mounted on an axis that is elastically supported on the latch member to bias the roller against a ramp surface formed on the printhead, when the latch member is in the latched position. The ramp surface has a normal that extends in a plane spanned by two mutually orthogonal directions and is inclined relative to both of said directions. In this way, the printhead is simultaneously biased in the two mutually orthogonal directions against the walls of the bay.

The use of a roller instead of a cam for engaging the ramp surface of the printhead reduces the frictional forces that have to be overcome when the printhead is brought into its final position, and thereby assures that the printhead will reach its intended position with improved reliability. Moreover, since the biasing mechanism comprises a movable latch member, the movement of this latch member may be utilized to optimise the direction in which the roller presses against the ramp surface, so that the printhead is brought into engagement with the support points in a well defined manner, and the frictional resistance occurring at the support points can safely be overcome.

Preferably, the latch member is a lever that is pivotally supported at the casing and snaps-in at a catch of the casing when it reaches the latched position. In order to assure that the coupling members are brought into engagement in a linear movement, the coupling member on the side of the casing is preferably guided in a stationary guide and is suspended at the lever by means of a rig which transforms the pivotal movement of the lever into a linear movement of the coupling member along the guide.

The axis of roller is preferably mounted at a first arm of a two-armed auxiliary lever that is pivotable about a fulcrum defined by the latch member. A spring for biasing the roller against the ramp surface is supported between a second arm of the auxiliary lever and the portion of the latch member. Preferably, the arrangement is such that when the latch member is brought into the latched position, the roller is pressed against the ramp surface in a direction that is approximately normal to the ramp surface. As a consequence, the force exerted onto the ramp surface by the roller has components that press the printhead against the support points in both of said mutually orthogonal directions.

A contact member is arranged to be elastically biased against a contact surface of the printhead in one of said directions, so that the biasing force will reliably be overcome by one of the components of the force exerted by the roller.

Preferably, a straight imaginary line that passes through the axis of the roller and through the fulcrum of the auxiliary lever extends approximately but not exactly normal to the ramp surface. Thus, when the latch member is brought into the latched position, a comparatively large component of the force that is transmitted through the auxiliary lever will firmly press the roller against the ramp surface, while a smaller component of that force will cause the roller to roll along the ramp surface and to pivot the auxiliary lever about its fulcrum against the force of the spring. Then, when the latch member is in the latched position, the spring will continue to bias the roller against the ramp surface, and the wedge action of the ramp surface assures that the printhead is pressed against the support points with an increased force.

BRIEF DESCRIPTION OF THE DRAWINGS

A preferred embodiment of the present invention will now be described in conjunction with the following drawings, wherein.

DETAILED DESCRIPTION OF THE INVENTION

Figure 1:
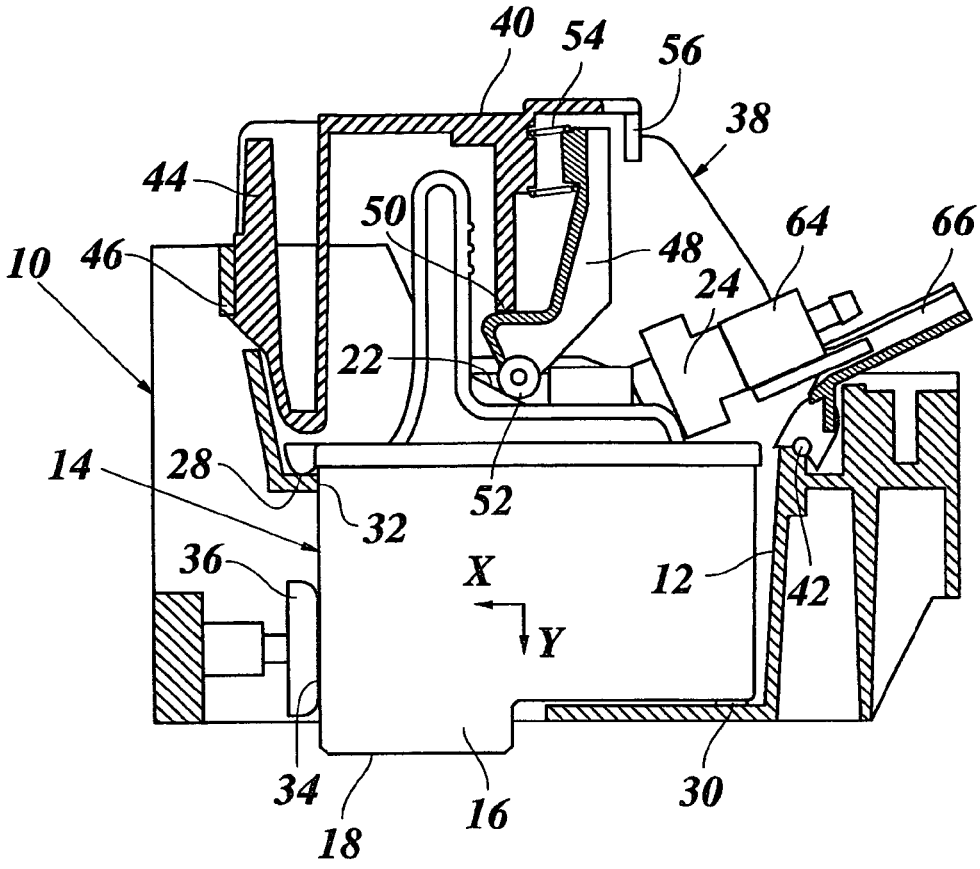
FIG. 1 is a sectional view of a mounting structure for an ink jet printhead.

As is shown in FIG. 1, a casing 10, which may form part of a carriage of an ink jet printer, defines a bay 12 which accommodates a printhead 14.

Figure 2:
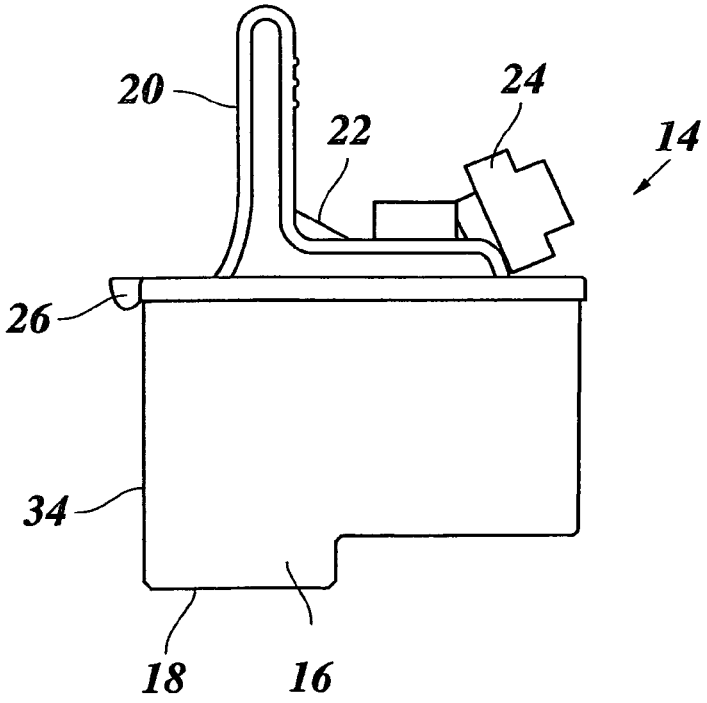
FIG. 2 is a separate view of the printhead.

The printhead 14, which has been shown separately in FIG. 2, has an essentially rectangular box-like shape with a projection 16 which projects downwardly through an opening in a bottom wall near the left corner of the bay 12 and defines a nozzle face 18. On the top side, the printhead is provided with a handle 20 which permits gripping the printhead and inserting it into the bay 12, a ramp surface 22, and a coupling member 24 for connecting the printhead to an ink supply line. In the top left corner of FIG. 2, the printhead has a laterally and downwardly projecting nose 26.

The print elements of the printhead are formed by a number of nozzles that are formed in the nozzle face 18 and are not visible in the drawing. These nozzles must be positioned with very high accuracy relative to the casing 10. To this end, the printhead 14 is supported in the bay 12 at three support points 28, 30 and 32 which define small, practically point-like, contact areas between the printhead and the walls of the bay 12. The support point 28 is formed by a horizontal wall of the casing which is engaged by the nose 26 of the printhead. The support point 30 is formed by a small boss in a corner of the printhead diagonally opposite to the nose 26. The boss may be formed either on the printhead or on the casing. The support points 28 and 30 define the position of the printhead in the vertical Y-direction (which, by definition, is the direction from the open side towards the bottom of the bay) and also the angular position of the printhead about a Z-axis normal to the plane of the drawing in FIG. 1. The third support point 32 is formed on an end face of the casing wall which defines also the support point 28. The support point 32 defines the position of the printhead in the horizontal X-direction.

Internally, the printhead 14 is provided with a number of actuators (not shown) that are associated with the individual nozzles. These actuators are controlled by a control circuit (not shown) that is provided outside of the printhead. Electrical connections between the control circuit and the actuators are provided by electrical contacts arranged in a contact face 34 of the printhead and by a contact member 36 that is elastically biased against the contact face 34. The contact face 34 is formed in an end wall of the printhead below the contact points 28 and 32. Thus, the biasing force of the contact member 36 tends to push the printhead away from the support point 32 in (negative) X-direction.

A biasing mechanism 38 is provided to hold the printhead in firm engagement with all three support points 28, 30 and 32 against the force of the contact member 36. The biasing mechanism comprises a latch member 40 that is pivotally connected to the casing 10 and is pivotable about an axis 42. The axis 42 is arranged approximately at the height of the support points 28 and 32 on the side of the printhead opposite to these support points. The free end of the latch member 40 forms an elastic claw 44 which, in the condition shown in FIG. 1, secures the latch member in the latched position by snapping-in at a catch 46.

A two-armed auxiliary lever 48 is arranged inside of the latch member 40 and is pivotable about a fulcrum 50 that is defined by the latch member. A first arm of the auxiliary lever 48 supports a roller 52 which engages the ramp surface 22 of the printhead. A compression spring 54 is supported at the latch member 40 and tends to tilt the auxiliary lever 48 in clock-wise direction in FIG. 1 about the fulcrum 50, thereby urging the roller 52 against the ramp surface. Since the normal of the ramp surface 22 is inclined relative to the X-direction and also relative to the Y-direction in the plane (X, Y), the force which the roller 52 exerts onto the ramp surface 22 has two components which urge the printhead 14 in X-direction against the support point 32 and in Y-direction against the support points 28 and 30.

Figure 3:
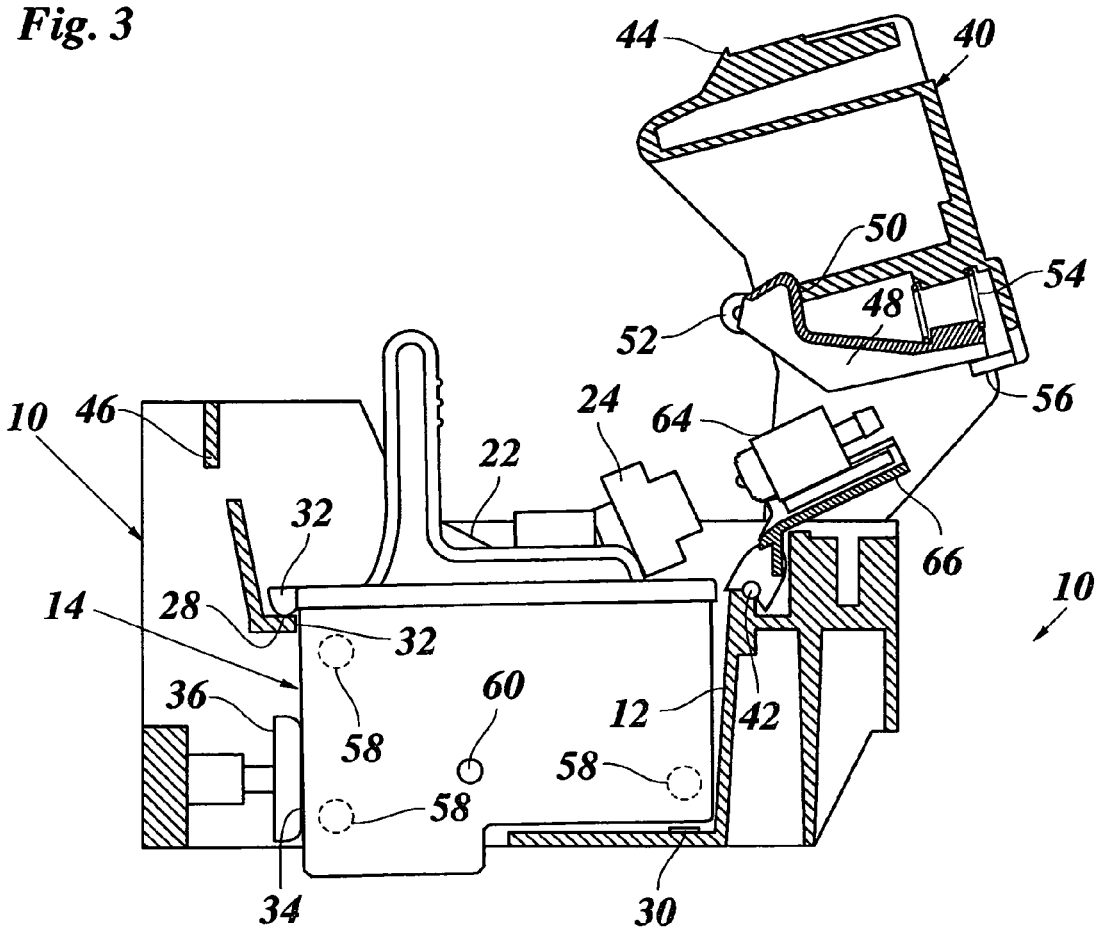
FIG. 3 shows the mounting structure of FIG. 1 during a process of insertion of the printhead.

FIG. 3 shows the latch member 40 in an open position permitting the insertion of the printhead 14 into the bay 12. The spring 54 urges the second arm of the auxiliary lever 48 against a stop 56.

Figure 4:
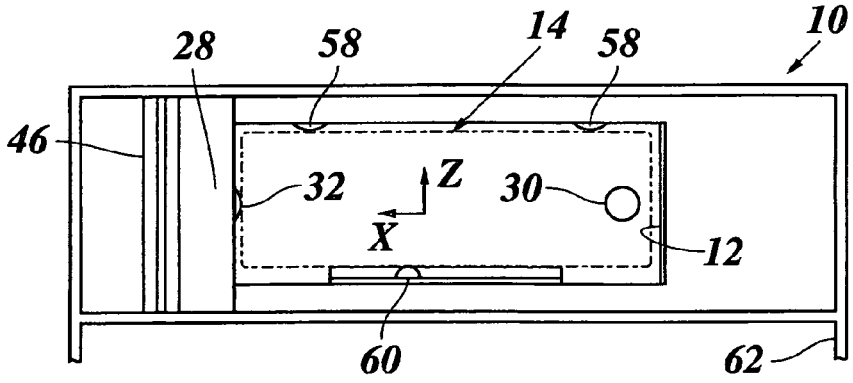
FIG. 4 is a top plan view of the mounting structure.

A rear wall of the bay 12, which is covered by the printhead 14 in FIG. 3, is provided with three additional support points 58 which are shown in phantom lines in FIG. 3 and two of which are also visible in FIG. 4. These support points 58 define the position of the printhead 14 in the Z-direction or, more exactly, the plane in which the printhead is movable in the X- and Y-directions. A leaf spring 60 is arranged on the internal wall of the bay 12 opposite to the support points 58 and urges the printhead against these support points. Thus, when the printhead is inserted into the bay, the frictional forces caused by the leaf spring 60 and the support points 58 has to be overcome.

In FIG. 3, the printhead is inserted into the bay, until the nose 26 engages the support point 28. However, the contact member 36 pushes the printhead away from the support point 32 and has slightly tilted it, so that it does not contact the support point 30, neither. When the latch member 40 is now pivoted counterclock-wise about the axis 42 towards the latched position shown in FIG. 1, the roller 52 will impinge on the ramp surface 22 and will push the printhead in both the X- and Y-directions.

It should be noted that the ramp surface 22 is located at a higher level than the axis 42 and slopes toward that axis. Thus, the direction of arcuate movement of the roller 52, when it hits the ramp surface 22, is almost perpendicular to this ramp surface. More specifically, the angle between the path of the roller 52 and the ramp surface 22 is larger than 45° and preferably larger than 80°.

Likewise, the angle formed between the ramp surface 22 and an imaginary straight line through the fulcrum 50 and the axis of the roller 52 is significantly larger than 45°. Thus, the force which the fulcrum 50 exerts upon the roller 52 via the auxiliary lever 48 has a major component in a direction perpendicular to the ramp surface 22 and only a small component in a direction parallel to the ramp surface. As a result, when the latch member 40 is finally locked in the latched position, the roller 52 exerts a relatively large force which reliably presses the printhead into engagement with all three support points 28, 30 and 32.

The relatively small force component which is directed in parallel with the ramp surface 22 and is thus not compensated by the reaction force of the ramp surface causes the roller 52 to roll along the ramp surface 22 with low friction, thereby tilting the auxiliary lever 48 about the fulcrum 50, with the compression of the spring 54. The force of the spring 54 will then safely hold the printhead in the intended position.

As is indicated in FIG. 4, the casing 10 may form a plurality of compartments 62 each of which accommodates a printhead and is provided with a mounting structure identical to the one described above. These mounting structures assure that all the printheads are accurately positioned relative to the casing 10 and, as a consequence, relative to one another.

When, in the condition shown in FIG. 1, the printhead 14 is to be removed, it is sufficient to press the claw 44 away from the catch 46 and then to tilt the latch member 40 into the open position shown in FIG. 3.

As is shown in FIGS. 1 and 3, the coupling member 24 of the printhead can be connected with and deconnected from a mating coupling member 64 that is itself connectable to an ink supply line (not shown). The coupling member 64 is guided in a guide rail 66 that is snap-fastened on the axis 42 and is held stationary in the casing 10, so that, when the printhead 14 is inserted, the coupling members 24 and 64 are aligned with one another.

Figure 5:
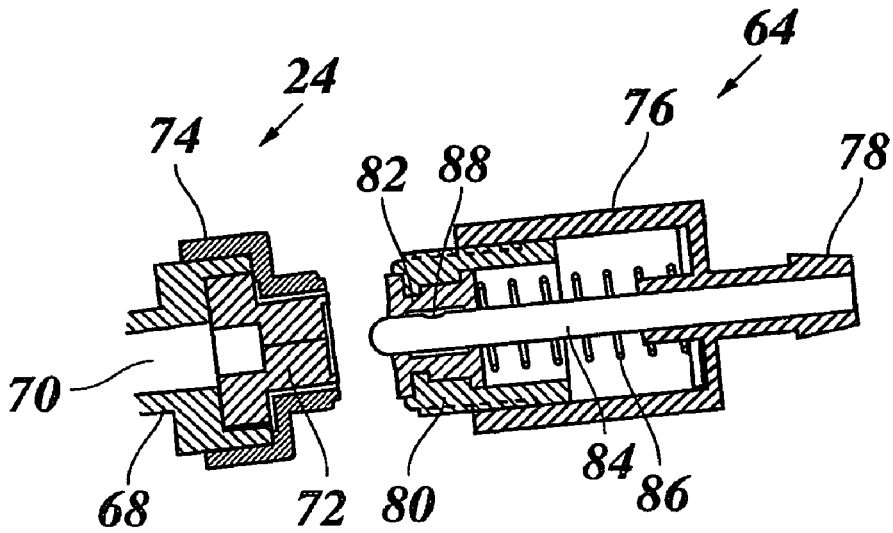
FIGS. 5 and 6 are sectional views of coupling members in an uncoupled and coupled state, respectively.
Figure 6:
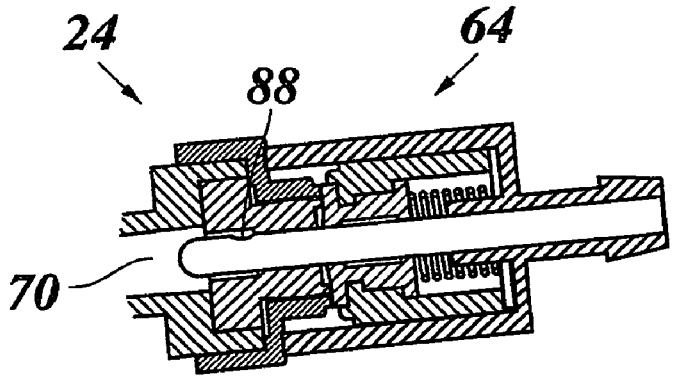

FIGS. 5 and 6 are longitudinal sections of the coupling members 24 and 64 in the uncoupled and the coupled state, respectively.

The coupling member 24 has a body 68 which defines a passage 70 that communicates with the interior of the printhead 14. In FIG. 5, the end of the passage 70 is closed by an annular seal member 72 made of a rubber-elastic material. The seal member 72 is locked in position by a cap 74.

The mating coupling member 64 has a cylindrical body 76 which defines a connector 78 for connection to a flexible ink supply tube (not shown). A piston 80 is slidingly guided in the body 76 and surrounds an annular sleeve 82. A needle 84 passes through the sleeve 82 and extends into the connector 78 with its rear end. In FIG. 5 a spring 86 biases the piston 80 into an end position defined by keys (not shown) that are formed on the internal wall of the body 76 and engage into grooves of the piston 80. The needle 84 has a closed front end and a lateral opening 88 which, in the end position of the piston 80, is located inside of the sleeve 82. The sleeve 82 is slidable on the needle 84 and defines two seal portions on both sides of the opening 88, so that the sleeve forms a valve which closes the ink supply line.

When the coupling members 24 and 64 are engaged with one another, as shown in FIG. 6, the cap 74 pushes the sleeve 82 and the piston 80 back into the cylindrical body 76 against the force of the spring 84. As a result, the front end of the needle 84 penetrates the seal member 72, so that its opening 88 communicates with the passage 70, thereby connecting the printhead to the ink supply line. When the coupling member 64 is drawn away from the coupling member 24, the condition shown in FIG. 5 is automatically restored by the spring 86.

Figure 7:
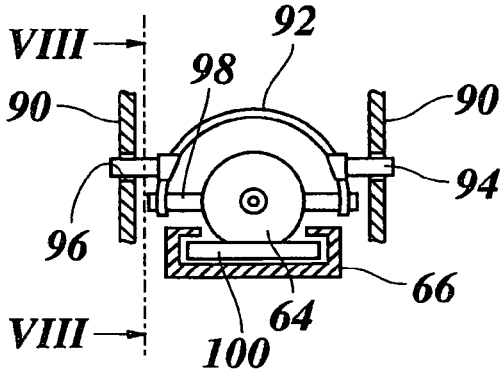
FIG. 7 is a sectional view of a suspension and guide mechanism for one of the coupling members shown in FIG. 5.
Figure 8:
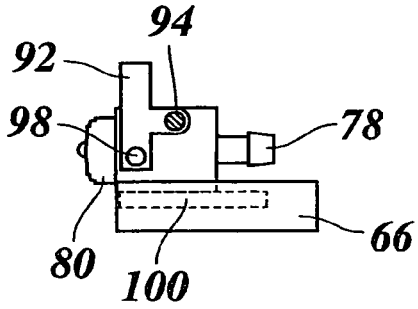
FIG. 8 is a sectional view taken along the line VIII-VIII of FIG. 7.

The latch member 40 is a U-shaped member with two parallel side walls 90, parts of which are shown in cross-section in FIG. 7. An arcuate rig 92 is suspended in the latch member 40 with two coaxial pivot pins 94 which engage elongated holes 96 in the side walls 90. The body of the coupling member 64 is suspended in the rig 92 by means of an axle 98 which is rotatably supported in the rig in a position offset from the pivot pins 94. A guide plate 100 is formed integrally with the body of the coupling member 64 and is guided in the guide rail 66. FIG. 8 is a side elevation showing the detailed configuration of the rig 92.

Figure 9:
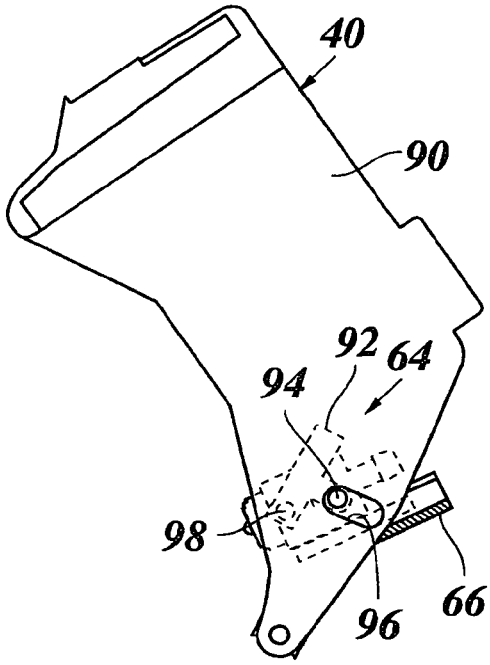
FIGS. 9 and 10 are schematic views illustrating the position of the suspension and guide mechanism in different conditions.
Figure 10:
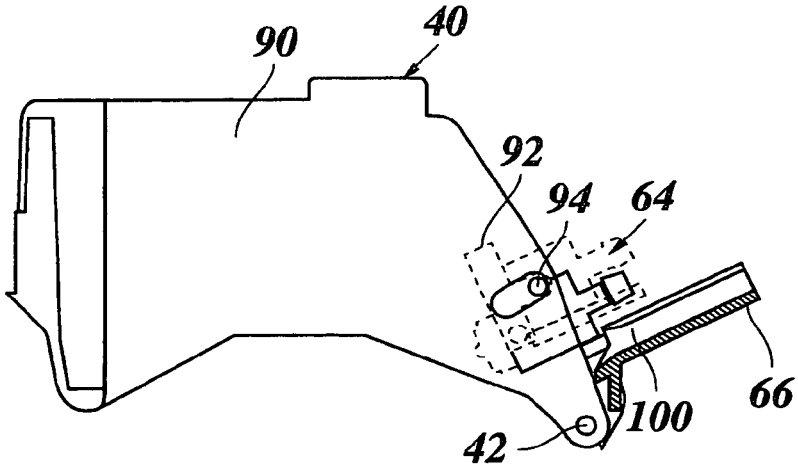

FIGS. 9 and 10 schematically illustrate the movement of the coupling member 64 when the latch member 40 is moved between the open position (FIG. 9) and the latched position (FIG. 10). In FIG. 9, the movement of the pivot pins 94 in the elongated holes 96 permits opening the latch member 40 sufficiently wide so that the printhead 14 can be inserted, as shown in FIG. 3. When the latch member is rotated counter-clock-wise, the pivot pins 92 move to the opposite ends of the elongated holes 96, as is shown in FIG. 10. Then, during the continued pivotal movement of the latch member 40 about the axis 42, the pivot pins 96 are pushed forward by the latch member, and a tilting movement of the rig 92 transforms the arcuate movement of the pivot pins 96 about the axis 42 into a linear movement of the coupling member 64 along the guide rail 66, until the latch member 40 has reached its latched position and the coupling member 64 is coupled to the coupling member 24 of the printhead, as shown in FIGS. 1 and 6.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A mounting structure for a printhead having a contact surface and a coupling member for connection to an ink supply line, the mounting structure comprising a casing which defines a bay for accommodating the printhead therein, and a biasing mechanism for biasing the printhead into engagement with the internal walls of the bay, the biasing mechanism including a latch member mounted on the casing and movable relative thereto between an open position which permits the printhead to be inserted into the bay, and a latched position where it secures the printhead in the bay, and a contact member adapted to exert a force against the contact surface of the printhead in the latched position, wherein a mating coupling member of the ink supply line is mounted on the latch member so as to be brought into engagement with the coupling member of the printhead when the latch member is moved into the latched position.

2. The mounting structure according to claim 1, for a printhead adapted to be held in engagement with the internal walls of the bay at a number of support points which define the position of the printhead in two mutually orthogonal directions (X, Y), the contact surface of the printhead being a ramp surface that has a normal incline relative to both said directions (X, Y) in the plane spanned by them when the latch member is in the latched position, wherein the contact member is a roller that is mounted on an axis that is elastically supported on the latch member to bias the roller against ramp surface.

3. The mounting structure according to claim 2, wherein the axis of the roller is mounted in a first arm of a two-armed auxiliary lever that is pivotable about a fulcrum defined by the latch member, and a spring for biasing the roller against the ramp surface is supported between a second arm of the auxiliary lever and a portion of the latch member.

4. The mounting structure according to claim 3, wherein a straight imaginary line that passes through the axis of the roller and through the fulcrum of the auxiliary lever forms an angle of more than 45° with the ramp surface when the printhead is inserted into the bay and the latch member is in the latched position.

5. A combination of a printhead with a mounting structure according to claim 2, wherein a first support point defining the position of the printhead in a vertical direction (Y), which is one of said two mutually orthogonal directions, is formed near a top corner of the printhead having essentially the shape of a rectangular box, the ramp surface rising from a top surface of the box near the center thereof when the printhead is inserted into the bay.

6. The combination according to claim 5, wherein a support point defining the position of the printhead in a horizontal direction (X), which is the other of said two mutually orthogonal directions, is located near the first support point.

7. The combination according to claim 5, wherein the axis of the latch member is located near the side of the bay opposite to the first support point.

8. The combination according to claim 5, wherein another support point defining the position of the printhead in vertical direction (Y) is located diagonally opposite to the first support point.

9. The combination according to claim 5, having a contact member that is biased against a contact face of the printhead when said printhead is inserted into the bay, said contact member being adapted to establish electrical contacts with the contact face and is located below the first support point.

10. A carriage for an ink jet printer comprising at least one combination of a printhead with a mounting structure according to claim 5.

11. The mounting structure according to claim 1, wherein the latch member is a lever that is rotatable relative to the casing about an axis.

12. The mounting structure according to claim 11, wherein said mating coupling member is guided in a linear guide rail that is stationary relative to the casing, and said mating coupling member is further coupled to the latch member by a rig which transforms the pivotal movement of the latch member into a linear movement of the coupling member along the guide rail.

13. The mounting structure according to claim 11, wherein the contact member is a roller, and the contact surface of the printhead is a ramp and wherein the location of the axis relative to the bay is such that, when the latch member is rotated, the arcuate path of the roller hits the ramp surface at an angle of more than 45°.

14. The mounting structure according to claim 11, wherein the contact member is a roller, and the contact surface of the printhead is a ramp and wherein the location of the axis relative to the bay is such that, when the latch member is rotated, the arcuate path of the roller hits the ramp surface at an angle of more than 80°.

15. A carriage for an ink jet printer comprising at least one mounting structure for a printhead according to claim 1.

* * * * *